US008871162B2

(12) United States Patent
Ostrea

(10) Patent No.: US 8,871,162 B2
(45) Date of Patent: Oct. 28, 2014

(54) PROCESS OF GOLD AND COPPER RECOVERY FROM MIXED OXIDE—SULFIDE COPPER ORES

(76) Inventor: Antonio M. Ostrea, Paranaque (PH)

( * ) Notice: Subject to any disclaimer, the term of this patent is extended or adjusted under 35 U.S.C. 154(b) by 0 days.

(21) Appl. No.: 14/112,685

(22) PCT Filed: Jun. 8, 2011

(86) PCT No.: PCT/PH2011/000009

§ 371 (c)(1),
(2), (4) Date: Oct. 18, 2013

(87) PCT Pub. No.: WO2012/053915

PCT Pub. Date: Apr. 26, 2012

(65) Prior Publication Data

US 2014/0044618 A1 Feb. 13, 2014

(30) Foreign Application Priority Data

Apr. 20, 2011 (PH) ..... 1-2011-00130

(51) Int. Cl.

| | |
|---|---|
| ***C22B 11/00*** | (2006.01) |
| ***C22B 3/00*** | (2006.01) |
| ***B03D 1/02*** | (2006.01) |
| ***C22B 1/00*** | (2006.01) |
| ***C22B 15/00*** | (2006.01) |
| *B03D 1/012* | (2006.01) |

(52) U.S. Cl.

CPC . *C22B 11/04* (2013.01); *B03D 1/02* (2013.01); *C22B 1/00* (2013.01); *C22B 11/00* (2013.01); *C22B 15/0002* (2013.01); *B03D 1/012* (2013.01); *C22B 15/0071* (2013.01); *B03D 2203/025* (2013.01)

USPC ..... 423/26; 423/41

(58) Field of Classification Search
None
See application file for complete search history.

(56) References Cited

U.S. PATENT DOCUMENTS

| | | | | |
|---|---|---|---|---|
| 3,403,020 | A * | 9/1968 | Lower | 423/26 |
| 3,582,317 | A * | 6/1971 | Tatsuichi et al. | 423/26 |
| 4,022,686 | A | 5/1977 | Arakatsu et al. | |
| 4,289,278 | A | 9/1981 | Itoh | |
| 4,416,770 | A | 11/1983 | Bresson et al. | |
| 4,460,459 | A | 7/1984 | Shaw et al. | |
| 4,579,651 | A | 4/1986 | Bresson et al. | |
| 4,601,818 | A | 7/1986 | Bresson et al. | |

(Continued)

FOREIGN PATENT DOCUMENTS

| | | | |
|---|---|---|---|
| CA | 1189204 | A1 | 6/1985 |
| CA | 1214578 | A1 | 11/1986 |

(Continued)

OTHER PUBLICATIONS

International Search Report and Written Opinion Issued by the European Patent Office for International Application No. PCT/PH11/00009 mailed Jan. 18, 2012 (8 pgs.).

*Primary Examiner* — Steven Bos
(74) *Attorney, Agent, or Firm* — Wilmer Cutler Pickering Hale and Dorr LLP

(57) ABSTRACT

The present invention relates to a process of gold and copper recovery from gold-containing copper ores obtained from mixed oxide-sulfide copper ore bodies by a series of flotation stages. More specifically, the present invention relates to a process of gold and copper recovery whereby gold-containing ores obtained from mixed oxide-sulfide copper ore bodies, and/or copper flotation by-products thereof, are subjected to at least one flotation step following a dewatering step. In particular, it recovers copper and gold from the oxidized zone of porphyry and other mixed ore deposits. Likewise, the present process allows recovery of copper and gold from the tailings and scavenger concentrates which, in conventional process are no longer viable for further treatment.

18 Claims, 2 Drawing Sheets

(56) References Cited

U.S. PATENT DOCUMENTS

| | | | |
|---|---|---|---|
| 4,710,361 | A | 12/1987 | Ostrea |
| 6,319,389 | B1 | 11/2001 | Fountain et al. |
| 2005/0081683 | A1 | 4/2005 | Lewins et al. |
| 2006/0032800 | A1 | 2/2006 | Correa-Castillo et al. |
| 2010/0242681 | A1 | 9/2010 | Nagase et al. |

FOREIGN PATENT DOCUMENTS

| | | | |
|---|---|---|---|
| CA | 1265876 | A1 | 2/1990 |
| CA | 2107963 | A1 | 4/1994 |
| CA | 2326081 | A1 | 5/2001 |
| GB | 389865 | A | 3/1933 |
| GB | 1248663 | A | 10/1971 |
| GB | 2009626 | A | 6/1979 |
| GB | 2029271 | A | 3/1980 |
| GB | 2029274 | A | 3/1980 |
| WO | WO-8900457 | A1 | 1/1989 |
| WO | WO-2003087416 | A1 | 10/2003 |
| WO | WO-2009072908 | A2 | 6/2009 |

* cited by examiner

PROCESS OF GOLD AND COPPER RECOVERY FROM MIXED OXIDE—SULFIDE COPPER ORES

FIELD OF THE INVENTION

The present invention relates to a system of gold and copper recovery from gold-containing copper ores obtained from mixed oxide-sulfide copper ore bodies by a series of flotation stages. More specifically, the present invention relates to a system of gold and copper recovery whereby gold-containing ores obtained from mixed oxide-sulfide copper ore bodies, and/or copper flotation by-products thereof, are subjected to at least one flotation step following a dewatering step. In particular, it recovers copper and gold from the oxidized zone of porphyry and other mixed ore deposits. Likewise, the present process allows recovery of copper and gold from the tailings and scavenger concentrates which, in conventional process are no longer viable for further treatment.

BACKGROUND ART

It is known that porphyry copper deposits predominate over other metals in a mixed metal deposit, which contain, among others, iron oxide copper gold deposits ("IOCG) and volcanogenic massive sulfide deposits. Examples of porphyry copper deposits are those found in El Salvador, Chile, and Bingham, Utah. The copper mines of Arizona, USA, including the mines of Bisbee, Tiger, Tombstone, Morenci, Mammoth and Ajo, Ariz., are the result of the supergene enrichment and hydrothermal alteration of a porphyry copper sulfide intrusion.

Porphyry type copper ore deposits amenable to strip mining usually consist of a primary zone of essentially sulfides of copper containing minute quantities of gold, an overlying layer or secondary zone of essentially oxidized copper minerals also containing minute quantities of gold, and a transition zone in between.

Copper sulfides in the supergene enrichment zone at the groundwater interface are, in general, identified as the economically significant class of minerals. Copper oxides at near surface or surface deposits are often considered to be not all that profitable themselves, and important only to the extent that they point prospectors to the supergene enrichment zone below.

It has been estimated that approximately 85% of the world's copper mining supply comes in the form of sulfide mineral ores. The remaining 15% comes in the form of oxide mineral ores.

These porphyry copper deposits contain other valuable metals and minerals, such as gold and silver. The Bingham Canyon Mine, for example, as of 2004, has yielded more than 17 MM tons of copper, 23 MM oz gold, 190 MM oz silver and 850 MM lbs molybdenum. The gold and silver are impurities removed from copper during refining.

Unlike the primary zone that responds readily to conventional flotation procedures, the recovery of metal values from the secondary zone (the copper oxide zone or zone containing copper by-products) has been limited to the prevailing practice of acid heap leaching to extract the acid soluble component of copper. In this process, the mined ore is crushed into small chunks and heaped on an impermeable plastic and/or clay lined leach pad where it can be irrigated with a leach solution, such as sulfuric acid, to dissolve the valuable metals. Either sprinklers or often drip irrigation are used to minimize evaporation. The solution then percolates through the heap and leaches out the acid soluble copper minerals. This can take several weeks. The leach solution containing the dissolved metals is then collected. This leaves behind a gold-containing residue that is laden with acid.

The drawback with this practice is that the gold values in the secondary (essentially copper oxide) ore are virtually untouched, and because of their very low gold content are uneconomic to recover by other means, and thus, end up in the waste dump. Aside from this disadvantage, said process employs acid consumption—with a tremendous environmental impact requiring some form of remediation—and is costly. Add to this the long holding and processing time to recover the copper as well as the required area for the leaching pad.

Prior art shows processes that have been developed for the flotation of copper oxide ores such as sulphidization with xanthate collector flotation. However, these processes have drawbacks. For example, in sulphidization, there is difficulty in controlling the sulphidizing agent and the irritating odor of said agent. Likewise the use of sulfides depresses gold values and prevents them from being floated, hence, recovery would be difficult and costly.

A number of collectors have been evaluated for copper oxide flotation without sulphidization and these include organic complexing agents, fatty acids, fatty amines and petroleum sulphonates. However, these collectors have met with limited success in the field because of their lack of selectivity. Other reagents/collectors have been evaluated but these significantly affect the cost of the flotation processes for oxides.

Conventional collectors such as xanthates do not perform well on oxidized surfaces. Sulphydric collectors such as xanthates are the most common collectors, however, they are highly selective for sulfide minerals and they chemically react with the sulfide surfaces and do not have affinity for the common non-sulfide minerals such as oxide or oxidized copper sulfide minerals. Studies have been made to combine xanthates with other collectors.

For example, U.S. Pat. No. 4,022,686 provides a flotation process for copper sulfide and copper oxide ores and for copper smelter slags, wherein benzotriazole or alkyl benzotriazole is added to the ground ores as an activator and then add one or more collectors selected from the group consisting of xanthates, dithiophosphates, thiocarbamate esters, dithiocarbamates, mercaptans and dixanthogens and further, if desired, a promoter such as kerosene, light oil, bunker oil or petroleum lubricant is added to improve the recovery for the flotation of copper ores or copper smelter slags. The conditioning of oxide ores by the addition of benzotriazole or alkylbenzotriazole is claimed to have a higher copper recovery than the sulfidizing process. The process however, is known to be viable for high grade ores.

GB 2029274A and GB 20096262 also describe other processes for the recovery of metal concentrates from mineral ores containing a metal or metal in the form of their sulphides and/or oxides by froth flotation of the crushed ore and using as collector a 2-mercapto aromatic amine and ortho hydroxyl phenyl oxime respectively. Both processes may have limited application to mineral ores containing one or more metals, i.e. copper, zinc, platinum, molybdenum, nickel, lead, antimony arsenic, silver and gold.

For gold recovery, the most common process is cyanide leaching, using cyanide to dissolve the gold. Froth flotation is usually applied when the gold present in an ore is closely associated with sulfide minerals. Direct cyanidation of gold-bearing ore generates tons of waste materials containing cyanide which can constitute an environmental hazard.

U.S. Pat. No. 4,710,361 describes the process of sulfhydric-fatty acid flotation at a pH range of about 5 to 8, in the recovery of gold from gold ores/cyanidation tailings. Likewise, WO2009/072908 provides another process for gold recovery by separating the sand from the primary slime, separating further the sand from the secondary slime and treating sand fractions with sulfhydric-fatty acid collector at a pH of about 6 to 8. These processes however apply only to gold recovery.

The above mentioned disadvantages or problems in the prior arts are solved by the present invention.

SUMMARY OF THE INVENTION

The present invention provides a system of gold and copper recovery whereby gold-containing ores obtained from mixed oxide-sulfide copper ore bodies, and/or copper flotation by-products thereof, are subjected to a sequence of coordinated flotation steps following a dewatering step to preconcentrate copper and gold and subsequently leach the copper values contained therein as well as gold metal from the acid-soluble copper minerals containing gold.

In accordance with one embodiment, ores emanating from mixed oxide-sulfide copper ore bodies containing gold undergo copper flotation using xanthate as a collector, after undergoing crushing, screening and grinding to specific size sufficient for mineral liberation. The copper flotation by-products from the copper flotation are subjected to at least one flotation step using a xanthate-fatty acid combination, following a dewatering step to recover copper and gold. The pre-concentration process applied prior to conventional leaching procedures, reduces the bulk of gold-enriched copper concentrate that would be amenable to acid leaching without sacrificing metal recovery. At the acid leaching stage, cleaner tails from copper flotation stage are mixed with the final gold concentrate containing the acid-soluble copper values to remove the acid-soluble copper including its oxides and reduce its contents before solid-liquid separation.

Another embodiment provides a process for the recovery of copper and gold wherein ores emanating from mixed oxide-sulfide copper ore bodies undergo at least one flotation stage using a combination of xanthate and fatty acid as collectors, after undergoing crushing, screening, grinding to appropriate size and dewatering. The copper-gold concentrate then undergoes acid leaching prior to solid-liquid separation.

In both embodiments, cleaner tails and scavenger concentrates can be recycled or further processed to recover the remaining gold and copper content.

Accordingly, several advantages of one or more aspects are as follows:

a) Gold is recovered along with the copper, instead of ending up in waste dump;
b) Gold-enriched oxide copper concentrate is reduced in bulk. Thus, the use of acid for leaching is significantly reduced;
c) Leaching time is likewise reduced from several weeks to only a few hours and leaching pad is no longer required;
d) Gold and copper that remain in the scavenger concentrates and copper flotation tailings are also efficiently recovered, and;
e) Waste and acid materials are also significantly reduced such that only 10% of the original ore is exposed to chemical treatment compared to existing technology where 100% is chemically treated and therefore, hazardous to the environment.

The above features and advantages of the present invention will be better understood with reference to the accompanying figures, detailed description and examples. It should also be understood that the particular process illustrating the present invention is exemplary only and is not to be regarded as a limitation of the invention.

BRIEF DESCRIPTION OF THE DRAWINGS

Reference is now made to the accompanying figures in which certain figures illustrate embodiments of the present invention from which its novel features and advantages will be apparent.

DETAILED DESCRIPTION OF THE INVENTION

Figure 1:
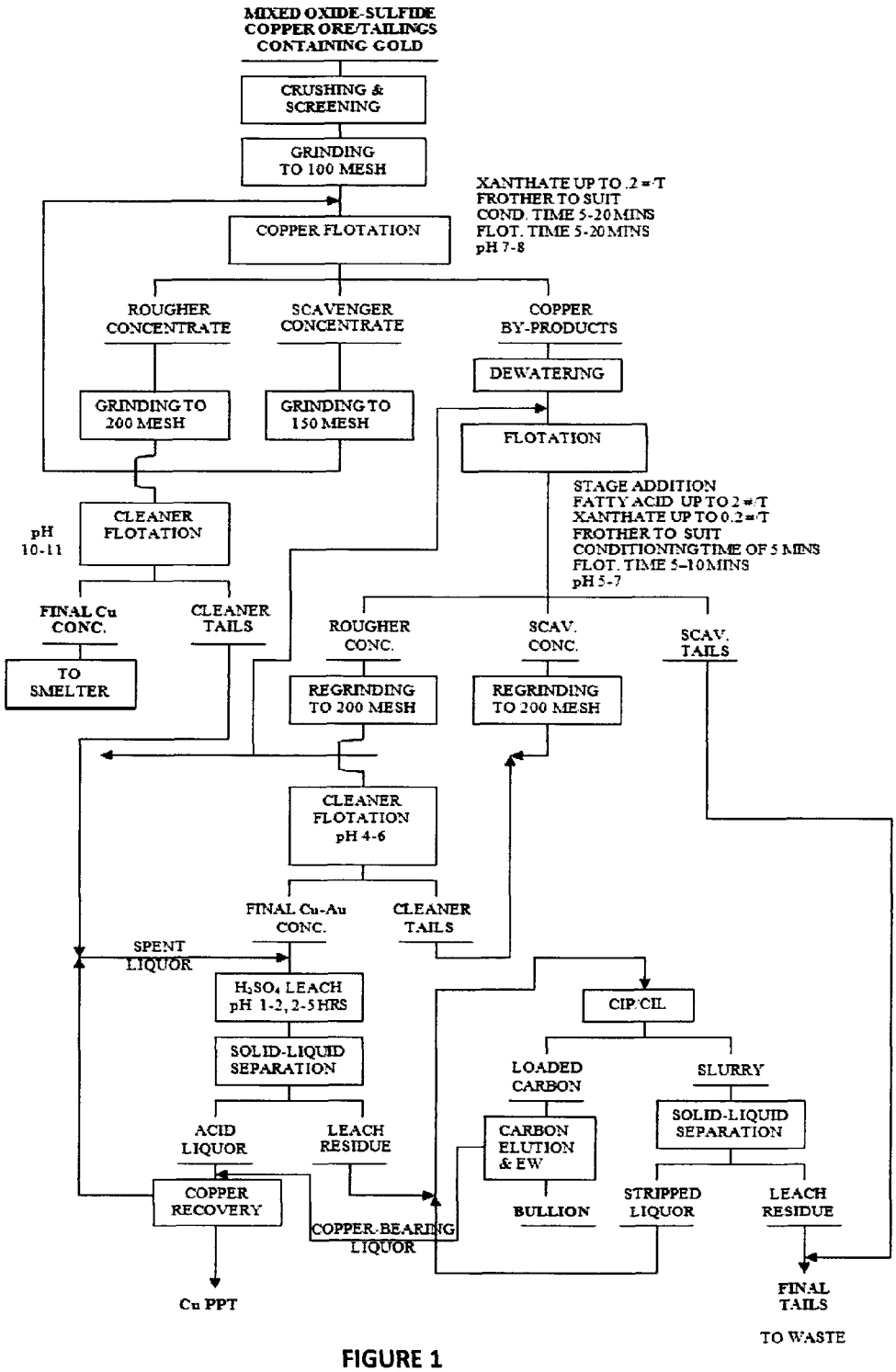
FIG. 1 shows a schematic representation of the system of gold and copper recovery according to the present invention.

The present invention provides a system of gold and copper recovery whereby gold-containing ores obtained from mixed oxide-sulfide copper ore bodies, and/or copper flotation by-products thereof, are subjected to at least one flotation step using a fatty acid-xanthate reagent combination as collector/promoter, following a dewatering step to recover copper and gold into a concentrate.

The system is viable for high grade as well as low-grade ores. Said system can be applied to gold-containing mixed oxide-sulfide copper ores containing gold to as low as 0.2 gm/MT concentrations and copper flotation by-products containing gold as low as 0.10 gm/MT.

Dewatering is an important step prior to flotation. The degree to which flotation of the desirable mineral(s) is achieved depends on many factors such as collectors, frothers, activators, pH, operation components such as feed rate, mineralogy, particle size, pulp density, temperature and many other parameters. However, in the case of flotation with the aid of fatty acids, the degree by which the collector is made to attach to the valuable mineral is governed by the intensity by which the reagent is made to "smear" on the surface of the valuable mineral. And this level of intense conditioning is enhanced by providing a high percentage of solids in the stirred suspensions of solids in water containing said collector. The second advantage of high solids conditioning is to provide the means to allow clustering of the "collected" valuable minerals as an aid to flotation kinetics. In other words, the rate at which the collected minerals attach themselves to the air bubbles in flotation is enhanced when clustering is present which, in effect, increases the successful encounter between the valuable mineral and the air bubbles.

One embodiment of the process is illustrated in Figure i. The gold-containing ore from mixed oxide-sulfide copper ore bodies is crushed, screened and ground to an appropriate size, preferably about wo Mesh, using conventional means known to a person skilled in the art, such as but not limited to the use of crushers and grinding mills. The ground materials are then made to undergo at least one-stage, preferably z-stage copper flotation at a pH range of about 7 to about 8 and a specified reaction time, preferably within 5 to 20 minutes for conditioning and 5 to 20 minutes for flotation, and more preferably within 5 minutes for conditioning and within 5 minutes for flotation, with xanthate as a collector, present in the amount of about 0.1 to about 0.2 lbs./T of feed.

The rougher concentrates obtained from said copper flotation are made to undergo further grinding and at least one-stage, preferably 2-3 cleaner flotation stages at pH of about 10 to about 11, and preferably by conventional means, such as but not limited to froth flotation, to obtain a final copper concentrate and cleaner tails, while the scavenger concentrates are made to undergo repeatedly the copper flotation cycle. The cleaner tails which were separated from the rougher concentrate will proceed to acid leaching.

The copper by-products from the copper flotation process undergo a dewatering step, and thereafter, a conditioning step of about 5 minutes followed by a flotation step at a pH range of about 5 to about 7, preferably at a pH of 5, and at a specified flotation time, preferably 5 to 10 minutes, using a fatty acid-xanthate reagent combination, as a collector or promoter of the gold present in the copper flotation by-products. The fatty acid-xanthate reagent combination may comprise about 0.5 to about 2 lbs/T fatty acid and about 0.1 to about 0.2 lbs/T xanthate. Copper by-products undergo at least one flotation stage, preferably two stages.

Suitable fatty acid collectors may be selected from fatty acids containing 8-20 carbons, preferably selected from the group consisting of caprylic, capric, oleic, linoleic, linoleic and arachidonic acids.

Xanthate may be sodium amyl xanthate or sodium isobutyl xanthate, which are available commercially.

Suitable frothers such as fuel oils or other oils may also be added during the flotation stage.

The rougher concentrates from said copper-by product flotation process are then subjected to regrinding to about 200 Mesh and further subjected to at least one, preferably two (2) cleaner flotation stages at pH of about 4 to about 6 to recover the final copper-gold concentrate. The scavenger concentrates, together with the dewatered copper flotation by-products, are made to undergo the flotation cycle.

The final copper-gold concentrate, together with the cleaner tails from the cleaner flotation steps of the rougher concentrate from copper flotation, is then made to undergo acid leaching, preferably with sulfuric acid, at a pH in the range of about 1 to about 2 until leaching is completed within 2 to 5 hours, more preferably 3 hours, to remove all acid-soluble copper, including its oxides, and reduce its copper content, which then undergoes solid-liquid separation, to recover the acid leach liquor as a supernatant liquid for copper recovery.

The leach residue is then subjected to a final leaching step by conventional means to extract and recover gold from liquor containing additional values of dissolved copper. Said conventional leaching means may be the Carbon in Pulp (CIP) process or the Carbon in Leach (CIL) process, both of which are known to a person skilled in the art.

Figure 2:
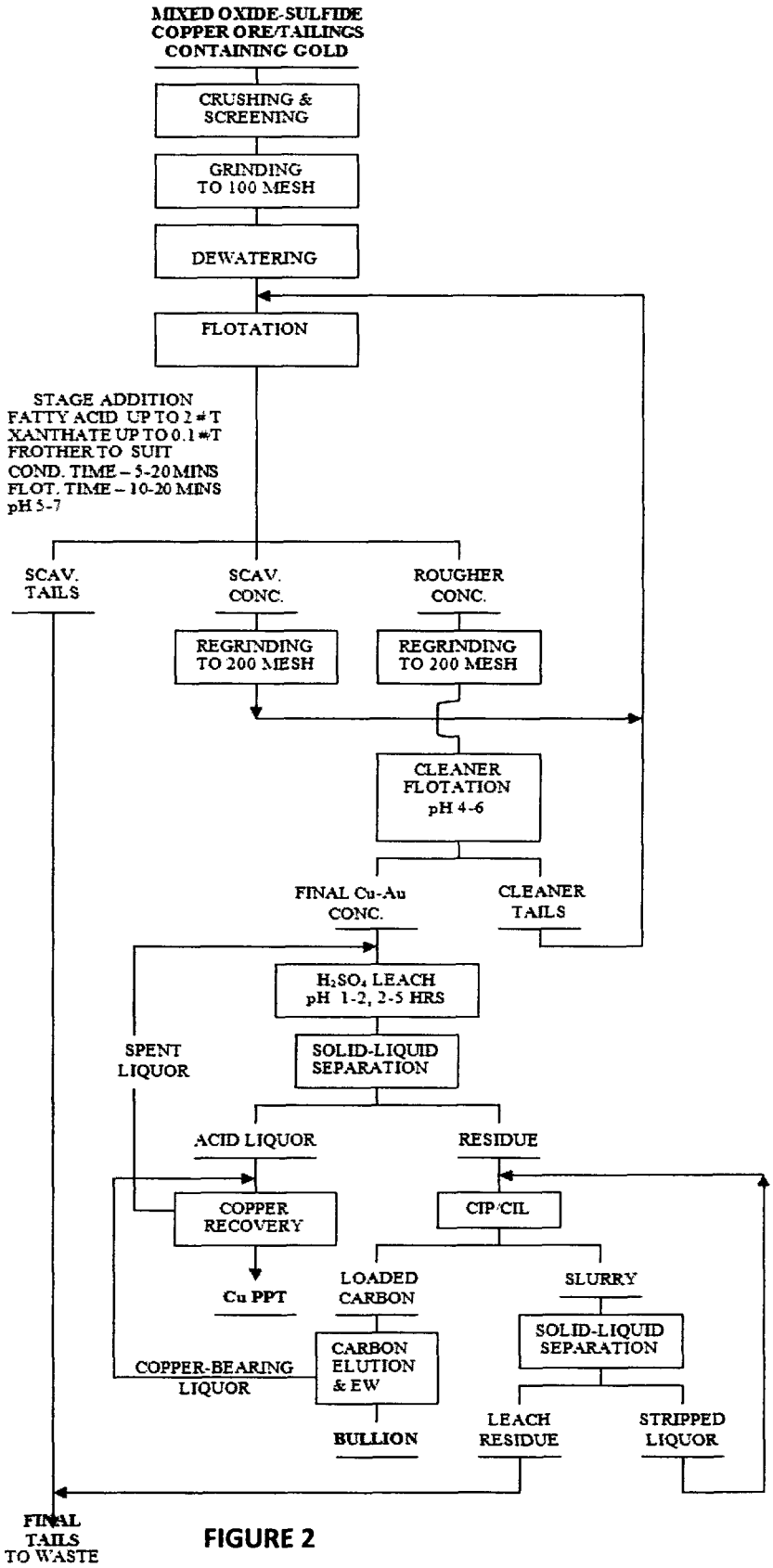
FIG. 2 shows a schematic representation of an embodiment of the system of gold and copper recovery according to the present invention.

Another embodiment of the process is shown in FIG. 2.

Similar to the previous process, the gold-containing ore from mixed oxide-sulfide copper ore bodies is crushed, screened and ground to appropriate size, preferably zoo Mesh, using conventional means known to a person skilled in the art, such as but not limited to the use of crushers and grinding mills. The ground materials are then made to undergo dewatering, and thereafter, at least one-stage, preferably two (2) flotation stages at a pH range of about 5 to 7 and a specified reaction time, preferably within 5 to 20 minutes for conditioning and 5 to 20 minutes for flotation, and more preferably within 5 minutes for conditioning and within 10 minutes for flotation, with a xanthate-fatty acid combination, as collectors, present in the amount of about 0.1 to 0.2 lbs./T Xanthate and about 2lbs/T Fatty acid. Frothers may be added during this stage.

The rougher concentrates from the flotation process is then subjected to regrinding to about zoo Mesh and further subjected to at least one, preferably two (2) or three (3) cleaner flotation stages at a pH of about 4 to about 6 to recover the final copper-gold concentrate. The scavenger concentrates undergo repeatedly, regrinding to about 200 Mesh and flotation.

The final copper-gold concentrate is then made to undergo acid leaching, preferably with sulfuric acid, at a pH in the range of about 1 to about 2 until leaching is completed within 2 to 5 hours, more preferably 3 hours, to remove all acid-soluble copper, including its oxides, and reduce its copper content, which then undergoes solid-liquid separation, to recover the acid leach liquor as a supernatant liquid for copper recovery.

The leach residue is then subjected to a final leaching step by conventional means to extract and recover gold and copper-bearing liquor. Said conventional leaching means may be the Carbon in Pulp (CIP) process or the Carbon in Leach (CIL) process, both of which are known to a person skilled in the art.

The copper and gold recovery system of the present invention will now be further illustrated with reference to the following examples.

EXAMPLE 1

30 kilos of an "L" ore containing 0.61% Cu and 0.70 gm/MT Au was crushed initially to ½ inch in size and further pulverized to produce a 65 mesh charge, sized in lots of 1.0 kg in weight. Grinding of the ore to finer sizes was accomplished with the aid of a ball mill rotating at fixed speeds but at varied grinding times. The ground materials were then made to undergo copper flotation at a pH of 8 for 20 minutes, subsequent to conditioning for 5 minutes, using 0.1 to 0.2 lbs Xanthate/ton of feed as a collector.

The rougher concentrates obtained from said copper flotation are made to undergo further grinding and cleaner flotation steps by conventional means, such as but not limited to froth flotation, to obtain a final copper concentrate and cleaner tails, while the scavenger concentrates are made to undergo again the copper flotation cycle.

The copper by-products from the copper flotation process underwent dewatering, conditioning for 5 minutes and flotation at a pH of 7, for 10 minutes, using an oleic acid-xanthate reagent combination, at a ratio of 2 lbs/T oleic acid and 0.2 lbs/T xanthate, as a collector or promoter of the gold present in said copper flotation by-products.

The rougher concentrates from the copper by-product flotation process were then subjected to regrinding to 200 Mesh and further subjected to two (2) cleaner flotation stages to recover the final copper-gold concentrate.

The final copper-gold concentrate, together with the cleaner tails from the cleaner flotation steps of the rougher concentrate from copper flotation, was then made to undergo acid leaching with sulfuric acid, at a pH of a for 5 hours, to remove all acid-soluble copper, including its oxides, and reduce its copper content. The acid-leached concentrate then underwent solid-liquid separation, to recover the acid leach liquor as a supernatant liquid for copper recovery.

The leach residue was then subjected to the Carbon in Leach (CIL) process to extract and recover gold. The copper-bearing liquor from carbon elution/EW undergoes copper recovery together with the acid liquor from $H_2SO_4$ leaching.

The tables below show the conditions and results of the system described in this Example.

TABLE IA

Test Results for Copper Flotation

| Product | Weight Percent % | Gold Assay g Au/t | Copper Assay % Cu | Gold Distribution % | Copper Distribution % |
|---|---|---|---|---|---|
| Cu Final Conc. | 0.37 | 67.80 | 25.53 | 35.65 | 15.63 |
| Cu Clnr Tails | 4.85 | 5.82 | 5.24 | 40.11 | 42.04 |
| Cu Scav. Tails | 94.78 | 0.18 | 0.27 | 24.24 | 42.33 |
| Calculated Head | 100.00 | 0.70 | 0.60 | 100.00 | 100.00 |
| Head assay | | 0.70 | 0.61 | | |

TABLE IIA

Test Results for Gold Flotation

| Product | Weight Percent % | Gold Assay g Au/t | Copper Assay % Cu | Gold Distribution % | Copper Distribution % |
|---|---|---|---|---|---|
| Au Final Conc. | 11.24 | 0.85 | 1.47 | 13.58 | 27.34 |
| Au Reclnr Tails | 6.26 | 0.67 | 0.55 | 5.96 | 5.70 |
| Au Clnr Tails | 9.32 | 0.28 | 0.31 | 3.71 | 4.78 |
| Final Flot. Tails | 67.96 | 0.01 | 0.04 | 0.97 | 4.50 |
| Calculated Head | 94.78 | 0.18 | 0.27 | 24.22 | 42.32 |
| Copper Scavenger Tails Assay | | 0.19 | 0.28 | | |

TABLE IIIA

Test Results for Combined Concentrate Leaching

| Product | Weight Percent % | Gold Assay g Au/t | Copper Assay % Cu | Gold Distribution % | Copper Distribution % |
|---|---|---|---|---|---|
| COMBINED CONCENTRATE (LEACH FEED) | | | | | |
| Au Final Conc. | 11.24 | 0.85 | 1.47 | 13.58 | 27.34 |
| Cu Cleaner Tails | 4.85 | 5.82 | 5.24 | 40.12 | 42.05 |
| Combined Conc. | 16.09 | 2.35 | 2.61 | 53.70 | 69.39 |
| LEACH PRODUCTS ACID LEACHING | | | | | |
| Leach Liquor | (48.16) | 0 | 0.54 | 0 | 43.03 |
| Leach Residue | 16.09 | 2.35 | 0.99 | 53.75 | 26.36 |
| Calculated Head | 16.09 | 2.35 | 2.61 | 53.75 | 69.39 |
| CIL LEACHING | | | | | |
| CIL Liquor | (48.27) | 0.741 | 0.24 | 50.84 | 19.17 |
| CIL Residue | 16.09 | 0.125 | 0.27 | 2.86 | 7.19 |
| Calculated Head | 16.09 | 2.35 | 0.99 | 53.70 | 26.36 |
| Combined concentrate assay | | 2.40 | 2.60 | | |

TABLE IVA

Overall Results for Flotation and Leaching Tests

| Product | Weight Percent % | Gold Assay g Au/t | Copper Assay % Cu | Gold Distribution % | Copper Distribution % |
|---|---|---|---|---|---|
| Cu Final Conc. | 0.37 | 67.8 | 25.53 | 35.66 | 15.63 |
| Au Reclnr Tails | 6.26 | 0.67 | 0.55 | 5.96 | 5.70 |
| Au Cleaner Tails | 9.32 | 0.28 | 0.31 | 3.71 | 4.78 |
| Final Flot. Tails | 67.96 | 0.01 | 0.04 | 0.97 | 4.50 |
| Acid Leach Liquor | (48.16) | 0.00 | 0.54 | 0.00 | 43.03 |

TABLE IVA-continued

Overall Results for Flotation and Leaching Tests

| Product | Weight Percent % | Gold Assay g Au/t | Copper Assay % Cu | Gold Distribution % | Copper Distribution % |
|---|---|---|---|---|---|
| CIL Liquor | (48.27) | 0.741 | 0.24 | 50.84 | 19.17 |
| CIL Residue | 16.09 | 0.125 | 0.27 | 2.86 | 7.19 |
| Calculated Head | 100.00 | 0.70 | 0.60 | 100.00 | 100.00 |
| Head Assay | | 0.70 | 0.61 | | |

The overall results for flotation and leaching tests show high copper and gold recovery at 86.5% for gold and 78% for copper. Rejection of waste material is very high at 84.05%, without creating a hazardous environment, as is the case with conventional technologies.

EXAMPLE 2

30 kilos of "B" ore containing 0.34% Cu and 0.44 gm/MT Au was crushed initially to ½ inch in size and further pulverized to produce a 65 mesh charge, sized in lots of 1.0 kg in weight. Grinding of the ore to finer sizes was accomplished with the aid of a ball mill rotating at fixed speeds but at varied grinding times.

The ground materials were then made to undergo copper flotation following dewatering at a pH of 7 within 10 minutes subsequent to a 5 minute -conditioning, using 0.2 lbs./T xanthate, as a collector.

The rougher concentrates obtained from said flotation were made to undergo further grinding and three (3) stages—cleaner flotation steps to obtain a final copper-gold concentrate and cleaner tails. These cleaner tails were made to repeatedly undergo the flotation cycle.

The final copper-gold concentrate was then made to undergo acid leaching, preferably with sulfuric acid, at a pH in the range of 1 to 2 and a specified leaching time, preferably 2 to 5 hours, more preferably 3 hours, to remove all acid-soluble copper, including its oxides, and reduce its copper content, which then underwent solid-liquid separation, to recover the acid leach liquor as a supernatant liquid for copper recovery.

The leach residue was then subjected to the Carbon in Pulp (CIP) process to extract and recover gold. The copper-bearing liquor from carbon elution/EW undergoes copper recovery together with the acid liquor from $H_2SO_4$ leaching.

The tables below show the conditions and results of the system described in this Example.

TABLE VI

Test Results for Gold Flotation

| Product | Weight Percent % | Gold Assay g Au/t | Copper Assay % Cu | Gold Distribution % | Copper Distribution % |
|---|---|---|---|---|---|
| Au Final Conc. | 9.86 | 4.11 | 3.08 | 91.83 | 89.43 |
| Final Flot. Tails | 90.14 | 0.04 | 0.04 | 8.17 | 10.57 |
| Calculated Head | 100.00 | 0.44 | 0.34 | 100.00 | 100.00 |
| Head Assay | | 0.44 | 0.34 | | |

TABLE VII

Test Results for Acid Leaching of Gold Concentrates

| Product | Weight Percent % | Gold Assay g Au/t | Copper Assay % Cu | Gold Distribution % | Copper Distribution % |
|---|---|---|---|---|---|
| Acid Leach Liquor | (269.90) | 0 | 0.036 | 0 | 28.50 |
| Acid Leach Residue | 9.86 | 4.11 | 2.10 | 91.83 | 60.93 |
| Calculated Head | 9.86 | 4.11 | 3.084 | 91.83 | 89.43 |
| Flotation concentrate assay | | 4.11 | 3.08 | | |

TABLE VIII

Test Results for Gold Concentrate CIL Leaching

| Product | Weight Percent % | Gold Assay g Au/t | Copper Assay % Cu | Gold Distribution % | Copper Distribution % |
|---|---|---|---|---|---|
| CIL Liquor | (39.26) | 1.03 | 0.494 | 91.61 | 56.88 |
| CIL Residue | 9.86 | 0.01 | 0.14 | 0.22 | 4.05 |
| Calculated Head | 9.86 | 4.11 | 2.11 | 91.83 | 60.93 |
| Acid leach residue assay | | 4.11 | 2.10 | | |

TABLE IX

Overall Results for Flotation and Leaching Tests

| Product | Weight Percent % | Gold Assay g Au/t | Copper Assay % Cu | Gold Distribution % | Copper Distribution % |
|---|---|---|---|---|---|
| Acid Leach Liquor | (269.90) | 0 | 0.036 | 0 | 28.50 |
| CIL Liquor | (39.26) | 1.03 | 0.494 | 91.61 | 56.88 |
| CIL Residue | 9.86 | 0.01 | 0.14 | 0.22 | 4.05 |
| Final Flot. Tails | 90.14 | 0.04 | 0.04 | 8.17 | 10.57 |
| Calculated Head | 100.00 | 0.44 | 0.34 | 100.00 | 100.00 |
| Head Assay | | 0.44 | 0.34 | | |

The overall results for flotation and leaching tests show high copper and gold recovery at 91.61% for gold and 85% for copper. Again, the rejection of waste material is very high at 90.14%, without creating a hazardous environment, as is the case with conventional technologies.

The potential of the system claimed here can be illustrated by comparing its test results with those of other patents. For instance, in U.S. Pat. No. 4,022,686, the feed material used was quite rich. The initial runs described in Tables a and 2 of the patent describe the feed to be at around 2.49%-2.75% Cu by weight (Ref. Table 2 thereof) which is described as a Chilean copper oxide ore. And the weight recovery of Cu as shown in the tails for the eleven (11) or so runs cited ranges from o.66% -2.07% Cu (by weight). The best results were obtained using a combination of the following reagents: 5-methyl benzotriazole, potassium amyl xanthate and a light oil with an estimated copper recovery in the rougher concentrate of 78.0%. The patent was an improvement over described recoveries using xanthates alone.

The best recoveries for U.S. Pat. No. 4,022,686 are described in Table 8 thereof where the feed material was about 5× richer, 13.9% Cu and the tails were 0.14% Cu.

In contrast, the Philippine ores described in our examples here had head assays of 0.61% Cu (Ex. a.) and 0.34% Cu (Ex.2), for both head assays. The Cu recoveries for the improved process in both cases were 78% to 85% respectively and significantly lower final flotation tails of 0.04% Cu, showing a marked improvement over the best result in the patent cited.

Therefore, using a Cu ore feed which was about 75% less rich in Cu weight, an improvement in recovery was obtained of at least 350% over the results in U.S. Pat. No. 4,022,686.

Likewise, for gold, the Philippine ores described in said examples had head assays of 0.70 g/T (Ex. 1) and 0.44 g/T (Ex. 2), respectively. The gold recoveries for the improved process in both cases were 86.5% and 91.61%, respectively, demonstrating the efficacy of this application to recover both Cu and Au effectively.

The unified system described in the present invention is capable of recovering copper and gold values from the sulfide component of the ore body into a smelter-ready concentrate in conjunction with a novel approach involving a series of flotation stages to derive a gold-enriched oxide copper concentrate reduced in bulk which would yield itself amenable to acid leaching of the acid-soluble component of the concentrate and a specialty system to recover the gold values remaining in said concentrate utilizing a non-cyanide leaching process for subsequent recovery of the gold into metal. The system also allows the recovery of gold from scavenger concentrate and copper flotation tailings economically.

The ultimate outcome of such a unified process is the production of those final products of economic value to the marketplace: a smelter-ready sulfide copper concentrate containing gold; a copper metal finished product; and Dore gold as well as an environmentally-friendly by-product consisting essentially of the original rock in pulverized form constituting almost 90% of the original ore body stripped of its valuable metal contents.

Due to its wide applicability over all kinds of copper ore bodies, this invention may be considered a "black box". The economic returns are enormous and forcefully demonstrate overall financial gain to the operator whereas in the past the results using conventional technology have been marginal if not outright dismal.

The invention claimed is:

1. A process for gold and copper recovery from mixed oxide-sulfide copper ores comprising the steps of:

crushing, screening and grinding the ores to appropriate size;

subjecting the ground ores to copper flotation, using xanthate as collector, and a suitable frother at a pH range of about 7 to about 8 to obtain a rougher concentrate, a scavenger concentrate and a copper by product, said rougher concentrate undergoes further grinding and flotation to obtain final copper concentrate and cleaner tails;

said scavenger concentrate undergoes further grinding before recycling to copper flotation stage; and said copper by-products undergo further processing by dewatering, then flotation at a pH range of about 5 to about 7 using a fatty acid-xanthate reagent combination as collector or promoter of the gold and a suitable frother to obtain rougher concentrate, scavenger concentrate and scavenger tails, subjecting said rougher concentrate to regrinding and cleaner flotation to separate the gold concentrate from the tailings, leaching the copper-gold concentrate with $H_2SO_4$ at a pH of about 1 to about 2 until leaching is completed within 2 to 5 hours followed by liquid-solid separation of the acid leach liquor containing copper and leach residue and finally, subjecting the leach residue to final leaching to extract and recover gold from a liquor containing additional values of dissolved copper or copper bearing liquor.

2. A process according to claim 1 wherein the xanthate at the copper flotation stage is present in the amount of about 0.1 to about 0.2 lbs/T of feed.

3. A process according to claim 1 wherein the pH at the copper by product flotation stage is 5.

4. A process according to claim 1, wherein the cleaner tails from the copper-flotation stage undergo leaching together with the final gold concentrate from copper by product flotation stage.

5. A process according to claim a wherein the xanthate-fatty acid combination is about 0.5 to 2 lbs/T fatty acid and about 0.1 to 0.2 lbs/T Xanthate.

6. A process according to claim 1, wherein the rougher concentrate from the copper-by product undergoes regrinding to about 200 mesh before being subjected to at least one cleaner flotation stage at a pH of about 4 to about 6 to separate the gold concentrate from the cleaner tailings.

7. A process according to claim 6 wherein the cleaner tailings are recycled to the copper-by-products flotation stage.

8. A process according to claim a wherein the leach residue from the sulfuric acid leach undergoes Carbon in Pulp or Carbon In Leach process to extract and recover the gold and copper bearing liquor.

9. A process according to claim 8 wherein the copper bearing liquor undergoes copper recovery together with the acid liquor from $H_2SO_4$ leaching.

10. A process according to claim a wherein the scavenger concentrate from the copper by-product flotation is reground to about 200 mesh before recycling to the copper-by-products flotation stage.

11. A process of gold and copper recovery from mixed oxide-sulfide copper ores comprising the steps of:

crushing, screening and grinding of the ores to appropriate size;

dewatering the ground mixed oxide-sulfide copper;

subjecting the dewatered ores to copper flotation in at least one-stage at a pH range of about 5 to about 7 using xanthate-fatty acid combination as collector and a frother, to obtain a rougher concentrate and scavenger concentrate, said rougher concentrate undergoes further grinding and cleaner flotation to separate the final gold concentrate from cleaner tails;

leaching final gold concentrate with $H_2SO_4$ at a pH of about 1 to about 2 until leaching is completed within 2 to 5 hours to recover the copper and leach residue;

subjecting the leach residue to final leaching to extract and recover gold from a liquor containing additional values of dissolved copper or copper bearing liquor.

12. The process according to claim 11, wherein the xanthate-fatty acid collector is present in an amount of about 0.1 to about 0.2 lbs/T Xanthate and about 2 lbs/T fatty acid.

13. The process according to claim 11, wherein the rougher concentrate is reground to about 200 mesh before undergoing at least one cleaner flotation stage.

14. The process according to claim 11, wherein the scavenger concentrate is reground to about 200 mesh and recycled to the mixed oxide-sulfide flotation stage.

15. A process according to claim 11 wherein the leach residue from the sulfuric acid leach undergoes Carbon in Pulp or Carbon In Leach process to extract and recover the gold and copper bearing liquor.

16. A process according to claim 15 wherein the copper bearing liquor undergoes copper recovery together with the acid liquor from $H_2SO_4$ leaching.

17. A process according to claim 11, wherein the cleaner tails from the cleaner flotation stage are recycled to the mixed oxide-sulfide flotation stage.

18. A process according to claim 1 or 11 wherein the mixed oxide-sulfide copper ore contains gold to as low as 0.2 gm/MT concentrations.

* * * * *

UNITED STATES PATENT AND TRADEMARK OFFICE

CERTIFICATE OF CORRECTION

PATENT NO. : 8,871,162 B2
APPLICATION NO. : 14/112685
DATED : October 28, 2014
INVENTOR(S) : Antonio M. Ostrea It is certified that error appears in the above-identified patent and that said Letters Patent is hereby corrected as shown below:

In the Specification:

At column 4, line number 53, please delete “wo” and insert --100--.

At column 4, line number 56, please delete “z-stage” and insert --2-stage--.

At column 5, line number 51, please delete “zoo” and insert --100--.

At column 5, line number 65, please delete “zoo” and insert --200--.

At column 6, line number 56, please delete “of a for 5” and insert --of 1 for 5--.

At column 9, line number 50, please delete “Tables a and 2” and insert --Tables 1 and 2--.

In the Claims:

At column 11, claim number 5, line number 10, please delete “claim a” and insert --claim 1--.

At column 11, claim number 8, line number 21, please delete “claim a” and insert --claim 1--.

At column 11, claim number 10, line number 28, please delete “claim a” and insert --claim 1--.

Signed and Sealed this
Fifteenth Day of March, 2016

Michelle K. Lee

Michelle K. Lee
*Director of the United States Patent and Trademark Office*